United States Patent [19]

Lederer

[11] 4,173,717

[45] Nov. 6, 1979

[54] OPTICAL ASSEMBLY

[75] Inventor: David B. Lederer, Rochester, N.Y.

[73] Assignee: Detection Systems Inc., Fairport, N.Y.

[21] Appl. No.: 872,885

[22] Filed: Jan. 27, 1978

[51] Int. Cl.[2] ..... H01J 5/02

[52] U.S. Cl. ..... 250/239

[58] Field of Search ..... 250/216, 239, 221, 222, 250/223, 234, 235, 236

[56] References Cited

U.S. PATENT DOCUMENTS

| | | | |
|---|---|---|---|
| 3,653,021 | 3/1972 | Litman et al. | 250/239 |
| 3,679,906 | 7/1972 | Myers | 250/221 |
| 4,021,665 | 5/1977 | Haas et al. | 250/239 |

*Primary Examiner*—David C. Nelms

*Attorney, Agent, or Firm*—Warren W. Kurz

[57] ABSTRACT

An optical assembly comprising a spherically shaped optical module. A flexure member cooperates with a portion of a supporting housing to support the module for rotation in two mutually perpendicular planes. The assembly is particularly useful in photoelectric beam systems commonly known as "electric eyes".

9 Claims, 4 Drawing Figures

OPTICAL ASSEMBLY

BACKGROUND OF THE INVENTION

This invention relates to improvements in optical assemblies of the type commonly employed in photoelectric beam systems, sometimes known as "electric eye" systems.

The so-called "electric eye" is a photoelectric control system which typically comprises two photoelectric components. One component functions to produce and transmit a narrow beam of light, or some other form of electromagnetic radiation, across a space in which some event will occur which will somehow affect the intensity of the beam at remote position. The other component is positioned at the remote position to be irradiated by the beam and functions to sense the intensity of the beam and to provide some indication in the event the level of irradiation drops below or increases beyond a certain level. Both components typically comprise an optical system of some sort which serves either to collimate radiation emanating from a source (e.g., a light-emitting diode) or, alternatively, to focus received radiation on a radiation-sensitive element (e.g., a photodiode).

To maximize the sensitivity of photoelectric beam systems, the respective optical axes of the two spaced optical systems must be coincident. Since it is rarely possible in the field to mount the two components on a support such that the optical systems are perfectly aligned, it is common to provide in each optical system some means for adjusting the position of the optical axis relative to a supporting housing. Typically, a pivotally mounted reflective element is incorporated in each optical system to facilitate optical alignment. See, for instance, the mirror arrangement disclosed in U.S. Pat. No. 3,752,978. Using an adjustable mirror element enables the refractive element or elements to remain stationary and always focused upon the source of radiation or the radiation-sensitive element. However, there are certain disadvantages in using a separate adjustment mirror. For instance, the mirror itself represents additional manufacturing costs, it reduces system sensitivity due to its inherent optical losses, and it reduces alignment stability by doubling any angular displacement between the beam of radiation and the optical axis.

SUMMARY OF THE INVENTION

According to the present invention, there is provided an improved optical assembly which is particularly well suited for photoelectric "electric eye" systems. Unlike conventional assemblies, it incorporates no adjustable mirrors, yet the optical axis is readily adjustable in two mutually perpendicular planes. The optical assembly of the invention comprises a hollow spherical shell which houses both a lens and means for supporting an object, such as a light-emitting diode or a photodiode, at the focal point of such lens, and means for supporting the spherical shell in such a manner as to be manually rotatable in two mutually perpendicular planes, thereby enabling the optical axis of the lens to be varied relative to a support housing. The support means preferably comprises a flexure member which, when in a relatively unflexed state, cooperates with another similar member or a portion of the support housing to support the spherical shell for rotational movement in the two mutually perpendicular planes. When moved to a flexed state, the flexure member serves to lock the shell in a fixed position relative to the support housing. A disc which is rotatably mounted about an eccentric axis acts to change the state of flex of the flexure member. Preferably, the disc is provided with an aperture which aligns with an alignment pin formed in the interior of a cover plate assembly only when the flexure member is in a shell-locking position. By this fail-safe arrangement, the optical assembly cannot be put into use unless the lens-holding sphere is safely locked in its desired position.

The invention will be best understood from the ensuing detailed description of a preferred embodiment, reference being made to the accompanying drawings.

DETAILED DESCRIPTION OF THE PREFERRED EMBODIMENT

Figure 1:
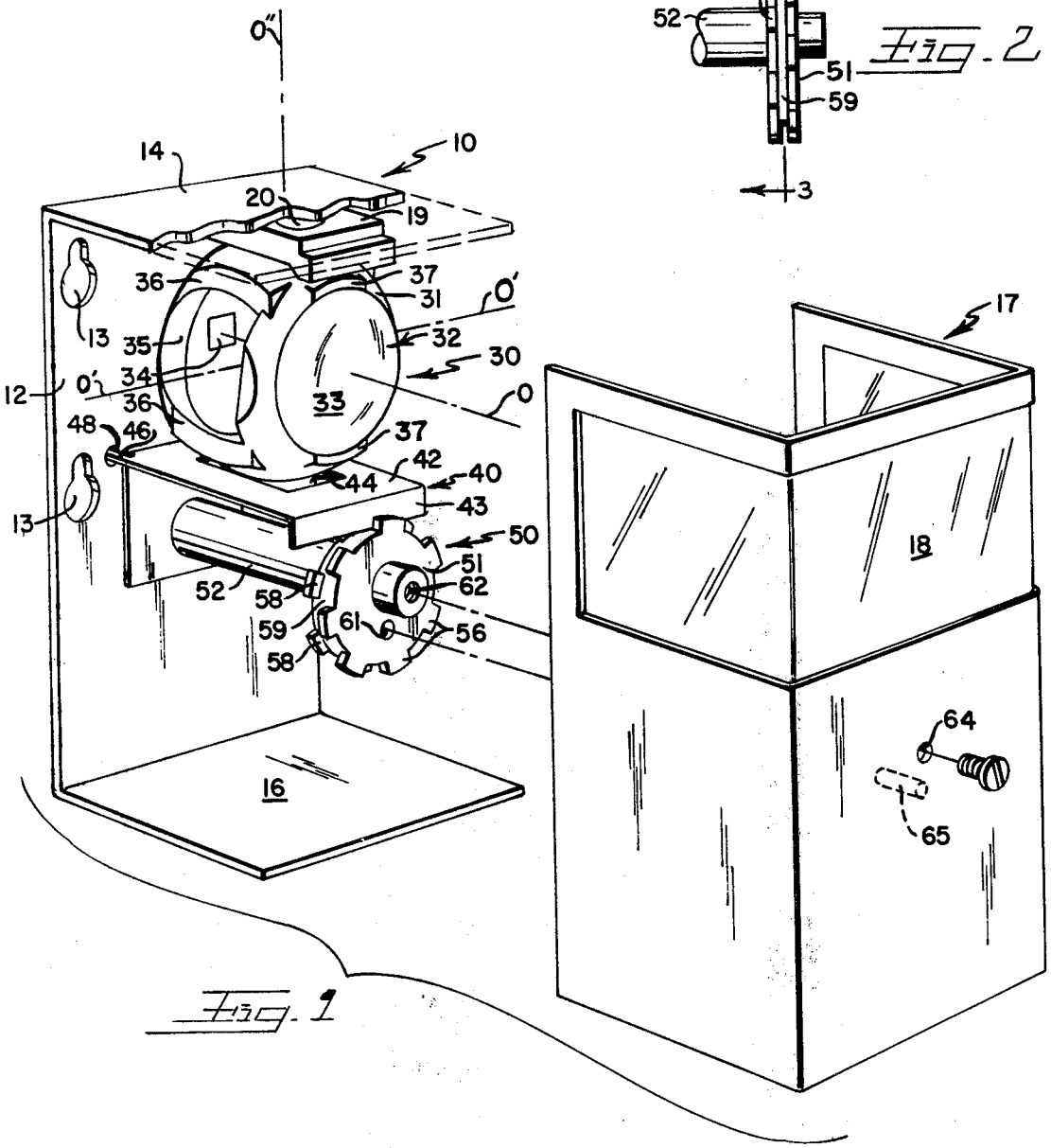
FIG. 1 is a perspective view of a preferred embodiment of the optical assembly of the invention.
Figure 2:
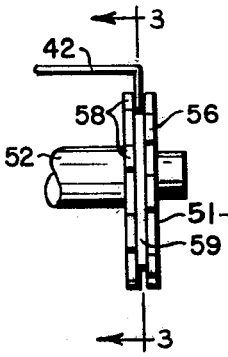
FIG. 2 is a side elevation of the locking mechanism.

Referring now to the drawings, a preferred embodiment of the invention is shown in perspective in FIG. 1. The optical assembly of the invention generally comprises a frame 10, a spherically shaped optical module 30, a flexible support 40, and a locking mechanism 50. Frame 10 is generally U-shaped, comprising a base portion 12 in which apertures 13 are formed for mounting the housing on a wall or other support, and a pair of spaced walls 14 and 16 which extend perpendicularly from the base portion. A U-shaped cover plate 17 cooperates with walls 14 and 16 to enclose the housing. The cover plate supports an optical window or filter 18 through which electromagnetic radiation of a desired wavelength can pass. The inside surface of wall 14 supports a pad 19 (shown in the cut-away portion of FIG. 1) having a circular aperture 20 formed in the central region thereof. As will be explained in more detail below, a flexible support 40 extending outwardly from base portion 12 cooperates with pad 19 to support the optical module 30.

The optical module 30 comprises a hollow, spherically-shaped shell 31 which supports in the front surface thereof a light-focusing element 32. Preferably, element 32 is a refractive lens 33 having a focal length slightly less than the diameter of the spherical shell. A transducer 34, such as a light-emitting diode or a photodiode, is positioned adjacent to the inside surface of shell 31, diametrically opposed from the element 32 on the optical axis O. Depending on the use of the optical assembly, such transducer provides either a source of radiation to be collimated by lens 33 to form a narrow beam of radiation, or a radiation-sensitive detector upon which incident radiation is focused by lens 33. Rather than supporting a refractive optical element, shell 31 could, of course, support a reflective optical system, such as a conventional Cassegrain or Newtonian system.

Spherical shell 31 is preferably fabricated from a plastic material so as to facilitate the formation of two relatively large apertures 35, formed in the opposing sides of the shell, through which access into the interior of the shell can be had for the purpose, for example, of accurately positioning a detector or radiation source at the focal point of the radiation-focusing element 32.

Support for the spherically shaped optical module is provided, in part, by a flexible support 40 which extends perpendicularly outward from the base portion of frame 10. As mentioned above, the flexible support cooperates with pad 19 to support the optical module therebetween. Support 40 comprises a flexure member 42, such as a thin metal plate, having a rectangular aperture 44 formed therein. Flexure member 42 is connected to the base portion of frame 10 by a pair of small tabs 46 which fit loosely in a pair of small apertures 48 formed in the base of frame 10. The forward edge of member 42 turns downwardly to form a lip 43. A locking mechanism 50 cooperates with lip 43 to move the flexure member between a relaxed state, in which the optical module is loosely supported in the apertures formed in pad 19 and in the flexure member, and a flexed state in which the shell is gripped tightly between the supporting members, and is thereby prevented from moving relative to frame 10. When loosely supported between pad 19 and flexure member 42, the optical module is rotatable in two mutually perpendicular planes, about axes O′ and O″. When the optical module is so supported, the position of the optical axis O of the focusing element 32 is readily variable and, hence, can be aligned with the optical axis of a similar remote unit. Preferably, the outer surface of shell 31 is provided with two sets of four arcuate ridges 36 and 37. Ridges 36 are positioned and shaped to contact pad 19 and flexure member 42 to prevent rotation of the optical module about the optical axis O. Ridges 37 are positioned to limit the angular range of rotation of the optical module in a vertical plane (i.e., about axis O′) to approximately 40 degrees.

Figure 4:
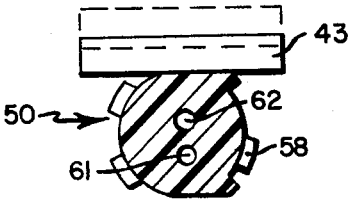
FIG. 4 is a sectional view of the locking mechanism shown in FIG. 3 showing the locking mechanism in an unlocking position.
Figure 3:
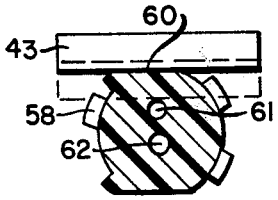
FIG. 3 is a sectional view of the locking mechanism shown in FIG. 2, the section being taken along the section line 3—3.

Locking mechanism 50 comprises a disc 51 which is rotatably mounted on a shaft 52 extending perpendicularly outward from the base portion of frame 10, below flexure member 42. Disc 51 is mounted so as to function as a cam. Along the periphery of disc 51, two sets of radially extending spaced tabs 56 and 58 are formed. Tabs 56 are axially displaced relative to tabs 58 to define a groove 59 for engaging the downwardly extending lip 43 of the flexure member. As disc 51 is rotated about shaft 52 in a clockwise direction, as viewed in the drawings, to a position shown in FIG. 3, the periphery of the disc engages lip 43 and forces the flexure member to bend upwardly, thereby tightly engaging and effectively locking the optical module between the flexure member and pad 19. A stop 60 formed in groove 59 prevents disc 51 from rotating beyond the position shown in FIG. 3. In this position, an aperture 61 in disc 51 is aligned with a locating pin 65 formed in the interior of cover plate 17 and allows proper placement of the cover plate 17 on housing 10. Cover plate 17 can be locked in place by inserting a screw through aperture 64 formed in the cover plate to engage a threaded aperture 62 formed in the end of shaft 52. Note, only when disc 51 is in a locking position can the cover plate be properly positioned on housing 10. This is a fail-safe arrangement for preventing the use of the assembly when the optical module is not locked in position. To unlock the optical module, disc 51 is rotated counterclockwise to the position shown in FIG. 4. In this position, the optical module is manually rotatable in the two planes discussed above.

While the invention has been described with particular reference to a preferred embodiment, variations and modifications will immediately occur to those skilled in the art without departing from the spirit and scope of the invention, as defined by the appended claims.

I claim:

1. An optical assembly for a photoelectric beam system, said assembly comprising (a) a frame;

(b) an optical module including a spherically shaped shell having a radiation focusing element mounted on the surface thereof for focusing incident radiation into the interior of said shell, said radiation-focusing element having an optical axis;

(c) a pair of spaced support members mounted on said frame for supporting said shell therebetween, at least one of said support members being movable between a first position in which said members cooperate to support said shell in such a manner as to enable said shell to be manually rotatable in at least two mutually perpendicular planes, and a second position in which said members cooperate to prevent rotation of said shell; and (d) locking means for selectively positioning said movable member in either said first or second position.

2. The optical assembly of claim 1 further comprising means for preventing said shell from rotating about the optical axis of said focusing element while said movable member is in said first position.

3. The optical assembly of claim 1 wherein said one support member comprises a flexure member which is adapted to be flexed between said first and second positions by said locking means.

4. The optical assembly of claim 1 wherein said locking means is movably mounted on said frame for movement between a first position in which said locking means urges said one support member into said second position thereof, and a second position in which said locking means allows said one support member to move to said first position thereof.

5. The optical assembly of claim 1 wherein said locking means comprises a disc, and means for rotatably mounting said disc on said frame for rotational movement about an eccentric axis, said disc being positioned such that the periphery thereof engages and moves said one support member between said first and second positions.

6. The optical assembly of claim 4 further comprising a cover plate which is adapted to cooperate with said frame to enclose said optical module, at least a portion of said cover plate being at least partially transparent to said radiation, said cover plate having an alignment member extending from a surface thereof, said alignment member being positioned to cooperate with said locking means to allow said cover plate and said frame to enclose said optical module only in the event said locking means is in said first position thereof.

7. The optical assembly of claim 1 wherein said locking means comprises a movably mounted cam which is movable between a first position in which said cam means allows said flexure member to assume the first position thereof, and a second position in which said cam means urges said flexure member into the second position thereof.

8. The optical assembly of claim 7 wherein said cam is rotatably mounted for movement between said first and second positions.

9. The optical assembly of claim 7 wherein said cam means includes first alignment means, and said assembly further comprises a cover plate which is adapted to cooperate with said frame to enclose said optical module, said cover plate being at least partially transparent to said radiation and including second alignment means which cooperates with said first alignment means to allow said cover plate and said frame to cooperate in enclosing said optical module only in the event said cam means is in said second position.

* * * * *